US005779076A

United States Patent [19]

Kano

[11] Patent Number: 5,779,076

[45] Date of Patent: Jul. 14, 1998

[54] PLASTIC CAP

[75] Inventor: Yuji Kano, Hiratsuka, Japan

[73] Assignee: Japan Crown Cork Co., Ltd., Japan

[21] Appl. No.: 623,088

[22] Filed: Mar. 28, 1996

[30] Foreign Application Priority Data

Mar. 29, 1995 [JP] Japan ..... 7-071300

[51] Int. Cl.[6] ..... B65D 41/34

[52] U.S. Cl. ..... 215/252; 215/258

[58] Field of Search ..... 215/252, 250, 215/258

[56] References Cited

U.S. PATENT DOCUMENTS

| | | | |
|---|---|---|---|
| 4,494,664 | 1/1985 | Guala | 215/258 X |
| 4,529,096 | 7/1985 | Chartier et al. | 215/252 |
| 4,577,770 | 3/1986 | Wright | 215/252 |
| 4,667,836 | 5/1987 | McLaren | 215/216 |
| 4,828,127 | 5/1989 | Young et al. | 215/252 |
| 5,027,964 | 7/1991 | Banich, Sr. | 215/258 X |
| 5,176,270 | 1/1993 | Battagazzore | 215/252 |
| 5,242,068 | 9/1993 | McCandless | 215/252 |
| 5,273,173 | 12/1993 | Debetencourt | 215/252 |
| 5,358,131 | 10/1994 | McCandless et al. | 215/252 |
| 5,402,901 | 4/1995 | Carvalheiro et al. | 215/252 |
| 5,573,128 | 11/1996 | Tsujiguchi et al. | 215/252 |

*Primary Examiner*—Allan N. Shoap
*Assistant Examiner*—Nathan Newhouse

[57] ABSTRACT

A plastic cap comprising a cap proper composed of a top panel and a skirt side wall, and a circumferential band provided in the lower end of the skirt side wall, wherein a screw for screwably engaging with the outer circumference of the neck of the container is formed in the inner surface of the skirt side wall, from the lower end of the skirt side wall, a circumferential band extends downwardly via a breakable line a plurality of bridge portions, in the inner surface of the lower portion of the circumferential band, a protrusion engageable with an engageable protrusion formed in the outer surface of the neck of the container is formed, and at least one flexible fin extending diametrically inwardly is provided in the inner surface of the circumferential band. When the container is tilted, the flexible fin is hooked on the jaw portion of the neck of the container, and is not removed from the neck of the container. Accordingly, in pouring out the liquid within the container, a trouble of the circumferential band falling into a vessel such as a cup together with the liquid in the container can be effectively prevented.

5 Claims, 3 Drawing Sheets

PLASTIC CAP

BACKGROUND OF THE INVENTION

1. [Field of the Invention]

The present invention relates to a plastic cap comprising a cap proper composed of a top panel and a skirt-like side wall suspending downwardly from a top panel circumferential edge portion and a circumferential band provided at the lower portion of the skirt-like side wall, and having tamper-evident (TE) characteristics, especially a plastic cap of the type in which the circumferential band showing TE characteristics is fixed by engagement with a ratchet claw formed on the outer circumferential surface of the neck portion of a container at the time of opening the cap.

2. [Prior Art]

The plastic cap having TE characteristics has a structure in which a circumferential band is formed via a circumferential direction weakening line at a lower portion of the cap proper. A representative example of this cap has flexible flap pieces on the inner surface of the circumferential band and in opening the cap, the flap pieces are engaged with the under side of the jaw portion of the container whereby the circumferential band is fixed, and in opening the cap proper, the weakening line is broken (see Japanese Patent Publication No. 32105/1983). Usually, this type of the cap is preferably constructed such that in opening the cap proper, the circumferential band should not remain in the mouth portion of the container, but is removed from the mouth portion of the container together with the cap proper which is desirable from the standpoint of separability and discardability.

In order to remove the circumferential band it has been widely practiced to form a high-strength bridge portion in a part of the circumferential weakening line, and form an axial direction weakening line which is connected with the circumferential direction weakening line in vicinity of the unbreakable high strength bridge portion and is extending along the axial direction (the height direction of the cap) of the circumferential band (for example, see Japanese Patent Publication No. 18421/1987). When the cap is opened, the circumferential weakening line excepting the high-strength bridge portion breaks and the axial direction weakening line breaks, whereby the circumferential band is connected to the cap proper via the high-strength bridge portion, and is removed off from the mouth portion of the container integrated with the cap proper.

However, in the plastic cap of the type using the flexible flap piece mentioned above, it was extremely difficult to surely break the circumferential direction weakening line or the axial direction weakening line at the time of opening the cap because of the elastic stretching of the flap piece or of the elastic stretching of the circumferential band itself. Hence, precision of the bridge strength is required, or in a type in which the axial direction weakening line is provided, when the cap proper is in a condition of being eliminated from the screw portion of the mouth portion of the container, the circumferential band remains fixed to the mouth portion of the container by its elongation. Thus, unless the axial direction weakening line is pulled off by pulling the cap proper upwardly, the cap proper cannot be eliminated from the mouth portion of the container.

To avoid the above inconvenience, the strength of the bridge portion should be weakened so that breakage of the circumferential or axial line direction can be easily performed. In this case, when the cap is tightly connected to the mouth portion of the container, the weakening line tends to be broken at the time that the circumferential band is riding over the jaw portion of the container, which has a larger diameter than that of the band.

Furthermore, presently there is a cap in which the fixation of a circumferential band in opening the cap is not carried out by the engagement of the flap piece of the circumferential band with the jaw portion of the container but is performed by utilizing a ratchet claw provided on the outer circumferential surface of the neck of the container (see Japanese Laid-Open Utility Model Publication No.131362/1981). In this type of the cap, protrusions pointing the cap opening direction are provided at fixed intervals on the inner circumferential surface of the band, and in opening the cap, the protrusions and ratchet claws on the outer circumferential surface of the neck of the container abut each other frontally whereby they are engaged with each other. Accordingly, after the cap proper has been removed from the mouth portion of the container, the circumferential band and the mouth portion of the container are not engaged with each other in an axial direction. Therefore, the circumferential band remaining at the mouth portion of the container is pulled up by hand, and it can be easily removed.

However, in the above-mentioned cap utilizing a ratchet claw, when the container liquid is poured into a cup by inclining the container without removing the circumferential band remaining in the mouth portion of the container, the circumferential band is removed out of the mouth portion of the container by the inclination of the container, and falls into the cup together with the contained liquid. This trouble frequently occurs.

Furthermore, there arises a problem in that after a contained liquid is filled into the container, when the cap is tightly bonded to the mouth portion of the container, a large force is added to the band at the time when the protrusions provided on the inner circumferential surface of the circumferential band ride over the ratchet claws of the neck of the container, and torsion occurs between the cap proper and the circumferential band, with the result that only the cap proper swivels in the cap closing direction and the weakening line breaks.

SUMMARY OF THE INVENTION

An object of the present invention is to provide a plastic cap having TE characteristics of the type in which a circumferential band is fixed at the time of opening the cap by utilizing engaging protrusions such as a ratchet claw provided on the outer circumferential surface of the neck of a container, wherein when the cap is opened and liquid in the container is poured out, the container is tilted without eliminating the circumferential band remaining in the mouth portion of the container separated from the cap proper, and accordingly, the circumferential band is not removed from the mouth portion of the container and does not fall.

Another object of the present invention is to provide a cap in which when the cap is tightly bonded to the mouth portion of the container in the production step, the breakage of the bridges is effectively prevented, and poor products do not form.

According to this invention, there is provided a plastic cap comprising a cap proper composed of a top panel and a skirt-like side wall suspending downwardly from the circumferential edge portion of the top panel and a circumferential band provided at the lower end of the skirt-like side wall, wherein in the inner surface of the skirt-like side wall a screw is formed for screwably engaging with an outer circumference of a neck of a container, the circumferential band is provided via circumferential breakable lines having a plurality of bridge portions, on the inner surface of the lower portion of the circumferential band, a protrusion capable of engaging with an engaging protrusion formed on the outer surface of the neck of the container is provided, and on the inner surface of the circumferential band, at least one flexible fin extending diametrically inwardly is provided.

In the present invention, the above flexible fin is preferably provided between mutually adjoining bridge portions.

Preferably, a stopper piece extending downwardly from the inner surface of a lower portion of the skirt-like side wall is provided, and a protruding portion is provided near the forward portion in the closing direction of the cap of the stopper piece in the inner surface of the circumferential band, whereby at the time of closing the cap, the protruding portion abuts with the stopper piece, and the cap proper and the circumferential band preferably swivel integrally.

This invention is importantly characterized in that a diametrically inwardly extending flexible fin is provided in the inner surface of the circumferential band. By opening of the cap, the circumferential band is cut from the cap proper and remains in the neck of the container, but when the container is tilted, the flexible fin is hooked at a jaw portion formed in the neck of the container, and does not come off from the neck of the container. Accordingly, in pouring out the liquid contained in the container, a trouble of the circumferential band falling down into a receptacle such as a cup together with the inner liquid is effectively prevented.

Since the fin is flexible, the band can be very easily taken off by pulling the remaining circumferential band with hand. Accordingly, in discarding the used containers, the circumferential band can be easily removed from the container, and there is no problem in separability and discardability.

In a preferred embodiment of this invention, a stopper piece extending downwardly is provided in the inner surface of the lower portion of the skirt-like side wall, and in the inner surface of the circumferential band, a projecting portion is formed near the front side in the closing direction of the cap of the stopper piece. This is for the purpose of effectively preventing the breakage of the bridge at the closing of the cap in the production step.

When the stopper and the protruding portion as mentioned above are provided, the stopper abuts with the protruding portion at the time of closing the cap. Accordingly, the cap proper and the circumferential band integrally swivel in the cap closing direction. Accordingly, even when the circumferential band is stranded on the jaw portion of the neck of the container, the circumferential band swivels forcibly integrally with the cap proper, and the breakage of the bridge in this condition can be effectively avoided.

BRIEF DESCRIPTION OF THE DRAWINGS

FIG. 4.A represents a side sectional view of a portion in which neither the stopper piece nor the bridge is formed; FIG. 4.B represents a side sectional view of a portion in which the bridge 12 is formed; FIG. 4.C represents a side sectional view of a portion in which the stopper piece is formed.

DETAILED DESCRIPTION OF THE INVENTION

The present invention will be described in detail below based on specific examples shown in the attached drawings.

Figure 1:
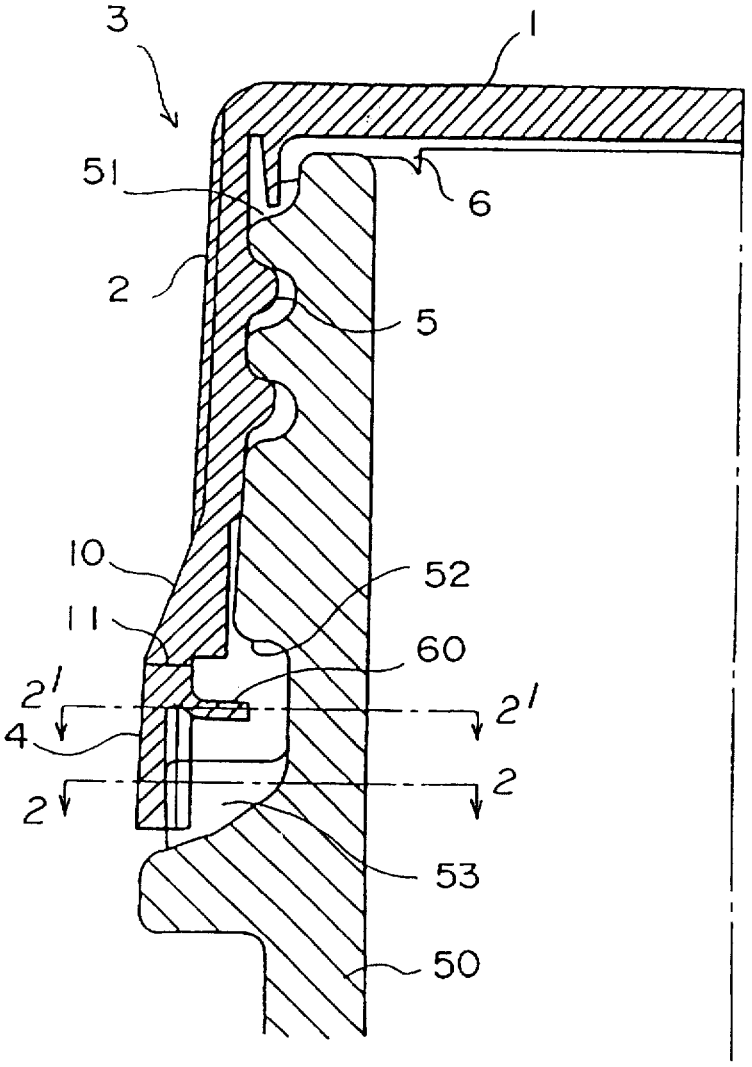
FIG. 1 is a view showing a side surface section of the plastic cap of the present invention together with the mouth portion of the container.
Figure 2:
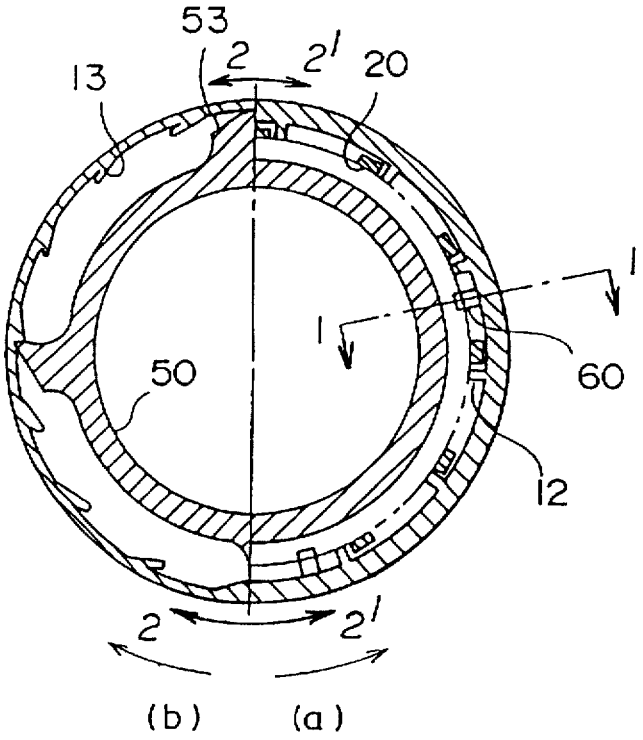
FIG. 2 is a top sectional view of the cap of FIG. 1.

FIG. 1 shows a half of the side sectional view of the plastic cap of the present invention together with the mouth portion of the container. FIG. 2 is a top sectional view of the plastic cap of FIG. 1, and the left half portion of FIG. 2 shows a top sectional view taken along line 2—2 of FIG. 1. The right half portion shows a top sectional view taken along line 2'—2' of FIG. 1. Incidentally, the half side sectional view of FIG. 1 is a side sectional view taken along line 1—1 in FIG. 2.

The cap of this invention is composed of a cap proper 3 formed from a top panel 1 and a skirt-like side wall 2 suspending from the circumferential edge portion of the top panel 1 and a circumferential band 4 positioned below the skirt-like side wall 2.

In the upper portion of the inner surface side of the skirt-like side wall 2, a threaded portion 5 is formed for threaded engagement with a threaded portion 51 is formed on the outer circumferential surface of the neck 50 of the container, and this cap is tightly bonded to the neck 50 of the container by a threaded engagement. Furthermore, a liner 6 is provided in the inner surface of the top panel 1, and in tight bonding of the cap, the liner 6 adheres intimately to the upper end (the mouth portion of the neck 50) of the container to maintain sealablity. On the other hand, at the neck 50 of the container, a jaw portion 52 is formed below the threaded portion 51 and further below the jaw portion 52, a plurality of ratchet claws 53 are formed.

Furthermore, a protruding portion 10 projecting outwardly is formed at the lower end of the skirt-like side wall 2, and at a lower end portion of this protruding portion 10, a circumferential band 4 is positioned via a breakable line 11 (see FIG. 1). The diameter of the circumferential band 4 is substantially larger than the diameter of the skirt-like side wall 2. Furthermore, among the breakable line 11, a number of bridges 12 (see FIG. 2) are formed at constant intervals, and these bridges 12 link the lower end of the protruding portion 10 with the circumferential band 4.

At the lower end of the circumferential band 4, a number of protruding pieces 13 (see FIG. 2) directed in an opening direction (shown by an arrow (a) in FIG. 2) are provided. In opening the cap, the protruding pieces 13 immediately abut with an engaging protrusion 53 such as a ratchet claw provided in the neck of the container to fix the circumferential band 4, whereby the break of the bridges 12 is easy and the circumferential band 4 can be accurately cut off from the cap proper 3. In this case, the protruding pieces 13 can be flexible in order to decrease the cap closing torque and prevent the breakage of the bridges.

According to this invention, a flexible flap or fin piece 60 is formed in the inner surface of the circumferential band 4 at a position between adjoining bridges 12. This flap piece 60 extends diametrically inwardly of the cap, whereby the circumferential band 4 remaining in the neck 50 of the container is prevented from being eliminated off the neck 50. When the cap is opened, the circumferential band 4 is cut off from the cap proper 3 and remains in the neck 50 of the container. Since the remaining circumferential band 4 has the flap piece 60 formed therein, even when the container is tilted without removing the band 4, the flap piece 60 is hooked on the lower side of the jaw portion 52 formed in the neck 50 of the container, and the falling of the circumferential band 4 is prevented. Accordingly, when the cap is opened and the container is inclined to pour a contained liquid into a receptacle such as a cup, there is no fear that the circumferential band 4 will fall together with the contained liquid.

In addition, since the flap piece 60 is flexible, when the used container is discarded and collected, it can be easily removed from the neck 50 of the container by pulling the circumferential band 4 will hands. Accordingly, the cap of this invention has excellent separability and discardability.

The flexible flap pieces 60 may be provided between all adjoining bridges 12. It may be provided in only one part so long as the falling of the circumferential band 4 remaining in the neck 50 of the container can be prevented. Usually, 2 to 4 flap pieces 60 are provided and placed symmetrically around the circumferential band 4.

In the present invention, the lower end portion (namely, the side of the circumferential band 4) of the bridge 12 is formed as a thickness and forms the protruding portion 40. At a position which becomes the vicinity of the protruding portion 40 from the side in the can opening direction of the bridge 12, the stopper piece 20 extending downwardly from the lower end of the skirt-like side wall 2 is preferably formed.

Figure 3:
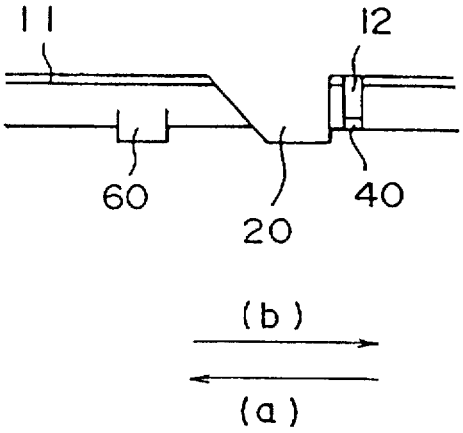
FIG. 3 is a view showing the positional relationship of the stopper piece provided in the cap of FIG. 1.
Figure 4A:
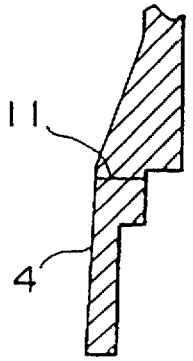
FIGS. 4.A, 4.B, 4.C illustrate side sectional views from the lower end of the skirt-like side wall in the cap of FIG. 1 to the circumferential band.
Figure 4B:
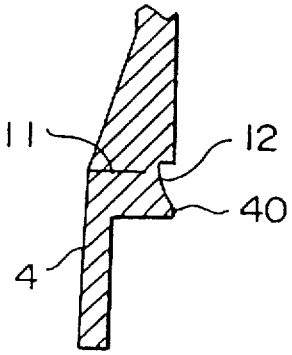
Figure 4C:
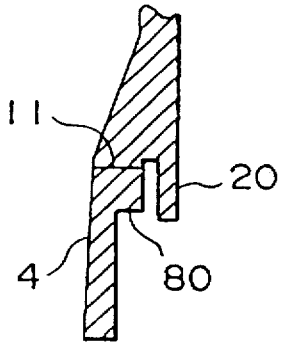

FIG. 3 shows the positional relation of the stopper piece 20, and FIGS. 4.A, 4.B, 4.C shows a side sectional view from the lower end of the skirt-like side wall 2 toward the circumferential band 4. FIG. 4.A is a side sectional view of a portion in which neither the stopper piece nor the bridge is formed, FIG. 4.B is a side sectional view of a portion in which the bridge 12 and the protruding portion 40 are formed, and FIG. 4.C is a side sectional view of a portion in which the stopper piece 20 is formed. Incidentally, in FIGS. 4.A, 4.B, 4.C, a protruding portion 13 provided at the lower portion of the circumferential band 4 is omitted.

As is clear by referring to FIGS. 3 and 4.A, 4.B, 4.C, the stopper piece 20 extends downwardly from the root portion in the inner surface side of the protruding portion 10 at the lower end of the skirt-like side wall 2 [FIG. 4.C]. Furthermore, at the lower end of the bridge 12, there is formed the protruding portion 40 which is thickened and lies on the stopper piece 20 [FIG. 4.B]. Furthermore, the stopper piece 20 is arranged in the vicinity of the protruding portion 40 in the cap closing direction side [arrow (b)] with respect to the bridge 12 (FIG. 3).

Accordingly, in closing the cap, a great restraint action works on the circumferential band 4 at the time when the protruding piece 13 provided at the lower end of the circumferential band 4 rides over the ratchet claw 53. But in the present invention, since the stopper piece 20 abuts with the protruding piece 40 at the lower portion of the bridge 12, the cap proper 3 and the circumferential band 4 integrally swivel in the cap closing direction. As a result, torsion does not occur between them and it becomes possible to effectively avoid the breakage of the bridge 12 at the time of closing the cap.

In the above-mentioned present invention, as long as the stopper piece 20 is held on a positional relation as in cap closing when the piece 20 abuts with the protruding portion 40, the protruding portion 40 does not need to be provided at the lower end of the bridge 12, but it may be provided in the inner surface of the circumferential band 4 quite separately from the bridge 12.

In closing the cap, there can be an arbitrary number of the stopper pieces 20 and the protruding portion 40 as long as the cap proper 3 and the circumferential band 4 integrally swivel.

As shown in FIG. 4.C, the sectional shape of the circumferential band 4 is composed of an upper thick portion and a lower reduced thickness portion which are connected via a horizontal portion [shown by 80 in FIG. 4.C]. In the present invention, the root of the protruding piece 13 provided in the lower end of the circumferential band 4 which abuts with an engaging protrusion 53 such as a ratchet extends from the inner surface of the reduced thickness portion of the circumferential band 4 in an inwardly diametrical direction and in a cap opening direction and is desirably integrally connected with the horizontal portion 80. By this arrangement, it is possible to increase the strength of the linking portion between the protruding portion 13 and the inner surface of the lower end of the circumferential band 4 while ensuring flexibility, and in closing the cap, it is possible to effectively prevent the breakage of the bridge 12. Furthermore, in opening the cap, the deformation of the protruding piece 13 can be effectively prevented when the protruding piece 13 abuts with the engaging protrusion 53. Thus, the TE function can be made accurate and in the step of producing the cap, the protrusion piece 13 will not be broken in pulling out the die after the end of the integral molding.

According to the present invention, the circumferential band 4 can be cut off from the cap proper and remain on the neck of the container after the opening of the cap and can be held at the neck of the container relatively stably. When the container is tilted, the flexible fin is hooked on the jaw portion of the neck of the container and it will not be removed from the neck of the container. Accordingly, when the liquid within the container is poured out, the trouble of having the circumferential band fall into the receptacle such as a cup together with the liquid can be effectively prevented.

In the present invention, the stopper piece extending downwardly from the lower end of the skirt-like side wall and the protruding portions formed in the inner surface of the circumferential band are provided in a certain positional relationship, whereby in closing the cap, the bridge abuts with the stopper and it is possible for the cap proper and the circumferential band portion to swivel integrally in the cap closing direction. Accordingly, at the time of cap closing in the production step, the breakage of the bridges can be effectively prevented. Thus, the ratio of developing poor products can be decreased, and the production efficiency increases.

What we claim is:

1. A plastic cap comprising:

a cap structure; and a circumferential band having, a lower portion, an inner surface, and at least one flexible fin which has an upper surface;

wherein the cap structure has a top panel which has, a circumferential edge portion, and a skirt having a lower portion and an inner surface, and suspending downwardly from the circumferential edge portion of the top panel;

the circumferential band having a circumferential breakable line which has a plurality of bridges, said circumferential band connected to the lower end of the skirt via the circumferential breakable line;

the inner surface of the skirt is threaded so as to be brought into a threaded engagement with an outer neck surface of a container which is also threaded;

the inner surface of the lower portion of the circumferential band having a protrusion formed thereon and adapted to come into engagement with an engaging protrusion that is formed at a lower portion of the outer neck surface of the container; and the at least one flexible fin extending inwardly from the inner surface of the circumferential band in a direction which is a diametrical direction of the top panel and spaced axially above the protrusion on the inner surface of the circumferential band so that the upper surface of the flexible fin can come into contact with the outer neck surface of the container.

2. The plastic cap set forth in claim 1, wherein the flexible fin is disposed between a pair of the bridges neighboring each other.

3. The plastic cap set forth in claim 1, wherein:

the inner surface of the skirt comprises a stopper extending downwardly from the lower portion of the skirt; and the inner surface of the circumferential band comprises a protruding portion facing the stopper in a direction in which the cap is closed;

whereby at the time of closing the cap, the protruding portion comes into contact with the stopper, and the cap structure and the circumferential band turn together.

4. The plastic cap set forth in claim 1, wherein the engaging protrusion at the neck of the container comprises a plurality of ratchet claws; and the protrusion formed on the inner surface of the circumferential band comprises a plurality of flexible projections having roots and maintaining a predetermined distance and extending along the inner surface of the circumferential band, in a direction in which the cap is opened.

5. The plastic cap set forth in claim 4, wherein:

the circumferential band comprises, an upper thick portion, the lower portion being thinner than the upper thick portion and having an inner surface, the thick portion being connected to the thin portion via a horizontal portion, and the roots of the flexible projections being connected to the inner surface of the thin portion and to the horizontal portion.

* * * * *